US009683559B2

(12) United States Patent
Usui et al.

(10) Patent No.: US 9,683,559 B2
(45) Date of Patent: Jun. 20, 2017

(54) FUEL PUMP

(75) Inventors: Takashi Usui, Toyota (JP); Kazuhiro Asayama, Toyota (JP)

(73) Assignee: TOYOTA JIDOSHA KABUSHIKI KAISHA, Toyota-Shi (JP)

( * ) Notice: Subject to any disclaimer, the term of this patent is extended or adjusted under 35 U.S.C. 154(b) by 290 days.

(21) Appl. No.: 14/236,596

(22) PCT Filed: Aug. 1, 2011

(86) PCT No.: PCT/JP2011/004356
§ 371 (c)(1),
(2), (4) Date: Jan. 31, 2014

(87) PCT Pub. No.: WO2013/018129
PCT Pub. Date: Feb. 7, 2013

(65) Prior Publication Data
US 2014/0199194 A1 Jul. 17, 2014

(51) Int. Cl.
*F04B 7/00* (2006.01)
*F02M 59/02* (2006.01)
(Continued)

(52) U.S. Cl.
CPC ..... *F04B 7/0015* (2013.01); *F02M 55/04* (2013.01); *F02M 59/022* (2013.01);
(Continued)

(58) Field of Classification Search
CPC .. F04B 11/0016; F04B 11/0033; F04B 53/22; F04B 53/166; F04B 53/168;
(Continued)

(56) References Cited

U.S. PATENT DOCUMENTS 3,277,837 A * 10/1966 Pangburn ..... F04B 53/1022 220/203.23
2004/0052652 A1* 3/2004 Yamada ..... F02M 59/102 417/273

(Continued)

FOREIGN PATENT DOCUMENTS

CN 101135283 A 3/2008
CN 101311523 A 11/2008

(Continued)

*Primary Examiner* — Devon Kramer
*Assistant Examiner* — Kenneth J Hansen
(74) *Attorney, Agent, or Firm* — Andrews Kurth Kenyon LLP

(57) ABSTRACT

Provided is a fuel pump comprising: a pump body; a plunger reciprocatably displaceable with respect to the pump body; and a plurality of valve elements inclusive of a suction valve to allow the fuel to be sucked into the fuel pressurizing chamber and a discharge valve to allow the fuel to be discharged out of the fuel pressurizing chamber, in which the pump body comprises a tubular valve retention member to retain the plurality of valve elements, a cylinder member to slidably retain the plunger, and an outer shell member having an inner wall surface facing an outer surface of the valve retention member, the inner wall surface and the outer surface of the valve retention member collectively forming a suction gallery chamber.

15 Claims, 10 Drawing Sheets

(51) Int. Cl.

| | |
|---|---|
| ***F04B 11/00*** | (2006.01) |
| ***F02M 63/00*** | (2006.01) |
| ***F02M 55/04*** | (2006.01) |
| ***F02M 59/36*** | (2006.01) |
| ***F02M 59/46*** | (2006.01) |

(52) U.S. Cl.
CPC ..... *F02M 59/368* (2013.01); *F02M 59/462* (2013.01); *F02M 63/005* (2013.01); *F04B 11/0016* (2013.01)

(58) Field of Classification Search
CPC .. F04B 7/0015; F02M 59/022; F02M 59/025; F02M 59/04; F02M 69/02
See application file for complete search history.

(56) References Cited

U.S. PATENT DOCUMENTS

| | | | | |
|---|---|---|---|---|
| 2005/0019188 | A1* | 1/2005 | Usui ..... | F02M 55/04 417/540 |
| 2008/0056914 | A1 | 3/2008 | Usui et al. | |
| 2008/0289713 | A1 | 11/2008 | Munakata et al. | |
| 2009/0110575 | A1 | 4/2009 | Munakata et al. | |
| 2012/0247591 | A1 | 10/2012 | Kuroyanagi et al. | |

FOREIGN PATENT DOCUMENTS

| | | | |
|---|---|---|---|
| EP | 2055934 | B1 | 5/2013 |
| JP | 2002-195128 | A | 7/2002 |
| JP | 2007-231959 | A | 9/2007 |
| JP | 2009-103008 | A | 5/2009 |
| JP | 2009-108784 | A | 5/2009 |
| JP | 2010-174903 | A | 8/2010 |
| JP | 2012215164 | A | 11/2012 |

* cited by examiner

FUEL PUMP

CROSS-REFERENCE TO RELATED APPLICATIONS

This is a national phase application based on the PCT International Patent Application No. PCT/JP2011/004356 filed on Aug. 1, 2011, the entire contents of which are incorporated herein by reference.

TECHNICAL FIELD

The present invention relates to a fuel pump, and more particularly to a fuel pump suitable to pressurize a fuel of an internal combustion engine to sufficiently high pressure for cylinder injection.

BACKGROUND ART

In recent years, there are known internal combustion engines for automotive vehicles employing an in-cylinder injection in which a fuel is directly injected to cylinders, while there are known other internal combustion engines employing the in-cylinder injection as well as an injection of a fuel to intake ports.

The internal combustion engines as described above that wholly or partly employ the aforementioned in-cylinder injection need to pressurize the fuel to be supplied to a fuel injection valve (injector) for in-cylinder injection to a fuel pressure higher than a fuel pressure of an internal combustion engine of port injection type in which the fuel is injected into the intake port, so that the internal combustion engines as described above often use a fuel pump designed to pressurize the fuel pumped from a feed pump by a plunger.

As the fuel pumps of this kind, there are known the fuel pumps comprising a plunger, valve elements, a valve holder and a member forming a fuel passage, the plunger being reciprocatably slidably arranged with respect a pump body (a pump housing), the valve elements being inclusive of a suction valve, a discharge valve and a relief valve and the like, the valve holder being adapted to hold the valve elements.

To be more specific, for example, conventionally known is a fuel pump designed to have a tubular member with a flange pressingly held in an engagement portion between a friction-proof cylinder slidably accommodating a plunger and a pump body, thereby making it possible to have differences in size and thermal expansion between the cylinder and the pump body absorbed in axial and diametric direction or to suppress an erosion of a seal portion caused by pressure propagation from a fuel pressurizing chamber (for example, see Patent Document 1).

Another conventionally known fuel pump is constructed to have an attachment member with a spring mechanism for urging a plunger attached therein and a cover member accommodating a valve body of an electromagnetic valve therein connected by a bolt, so that a cylinder is pressed from the both axial sides while an end portion of a cylinder with a discharge valve and a plunger arranged therein is held in engagement with the valve body, thereby realizing a miniaturization of the fuel pump and reduction of the seal portions (for example, see Patent Document 2).

Still another conventionally known fuel pump is constructed to have a pump housing, in which a valve is arranged, and a cylinder, in which a plunger is accommodated, held in engagement with each other, so that bonding metals are bonded together by diffusion bonding on a tapered bonding surface inclined with respect to an axis line of the cylinder (for example, see Patent Document 3).

CITATION LIST

Patent Literature

Patent Document 1: Japanese Patent Application Publication No. 2007-231959

Patent Document 2: Japanese Patent Application Publication No. 2002-195128

Patent Document 3: Japanese Patent Application Publication No. 2009-108784

SUMMARY OF INVENTION

Technical Problem

However, the fact that the previously mentioned conventional fuel pumps have a plurality of valve accommodation holes, to be arranged on the pump body, and attachment holes (fitting holes, press-fitting holes, screw holes, and the like), to be arranged on the valve holder or the fuel passage forming member and the like, directly arranged on the pump body modeling elements of complex shape, leads to the fact that the fuel pump has increased excess thickness portions functionally not needed, resulting in difficulties in the weight saving of the fuel pump, as well as that a costly machine such as a machining center is required, resulting in a higher manufacturing cost.

Particularly, in the case that the relief valve is arranged in addition to the suction valve and the discharge valve, these valves are assembled by forming a number of holes in different directions on the pump body, thereby increasing the size of the pump body structure.

Further, the size of the pump body structure has a tendency to be increased due to the necessity for the fuel pump to have the volume of the suction gallery chamber increased in order to suppress the pressure fluctuation in the fuel supply passage side caused by opening and closing the suction valve.

As will be understood from the foregoing description, the conventional fuel pump encounters such problems as being difficult in suppressing the excess thickness portions and the increase in the size of the pump body structure, so that it is difficult to miniaturize and save weight, resulting in lower productivity and higher cost.

It is therefore an object of the present invention to provide a fuel pump which can suppress an excess thickness and an increase in size of the structure of the pump body, so that the fuel pump is miniaturized and light-weighted, thereby making it possible to improve the productivity and lower the cost.

Solution to Problem

To achieve the previously mentioned object of the present invention, the fuel pump according to the present invention, (1) comprises: a pump body having formed in its inner portion with a fuel passage to allow a fuel to be introduced therethrough into the inner portion, a plunger provided in the pump body to partly form a fuel pressurizing chamber to allow the fuel to be introduced thereinto and discharged therefrom, the plunger being reciprocatably displaceable in an axial direction in which the fuel in the fuel pressurizing chamber is pressurized, and a plurality of valve elements inclusive of a suction valve to have the fuel to be sucked into the fuel pressurizing chamber and a discharge valve to have the fuel to be discharged from the fuel pressurizing chamber, the pump body including a valve retention member partly forming the fuel passage, the valve retention member being in a tubular shape to retain the valve elements therein, a cylinder member supported by the valve retention member and slidably retaining the plunger, and an outer shell member having an inner wall surface facing an outer surface of the valve retention member, the inner wall surface of the outer shell member and the outer surface of the valve retention member collectively constituting a fuel storage chamber.

By the construction as described above, the structure of the valve retention member, the cylinder member and the outer shell member can be simplified to an axial shape such as a tubular shape or a bottomed tubular shape, so that an excess thickness of the pump body can be largely reduced to save the weight of the pump body, while making it possible to drastically facilitate the machining of the fuel passage, the fuel pressurizing chamber and the like. Furthermore, the fuel storage chamber can be formed by the outer surface of the valve retention member and the inner wall surface of the outer shell member, so that the fuel storage chamber adapted to store the fuel to be introduced into the pump body can be made large in volume, thereby making it possible to effectively control the pressure fluctuations of the fuel to be introduced into the fuel pressurizing chamber.

The fuel pump according to the present invention may preferably be so constructed that (2) the outer shell member has a pair of first insertion holes and a second insertion hole formed therein, the first insertion holes having a center axis and penetrating through the inner wall surface in the same direction with each other, the second insertion hole having a center axis crossing with the center axes of the first insertion holes, either one of the first insertion holes and the second insertion hole having the valve retention member received therein and the other one of the first insertion holes and the second insertion hole having the cylinder member received therein.

By the construction as described above, either one of the valve retention member and the cylinder member can be supported at both ends by the outer shell member, to have the support rigidity increased, so that the supporting structure of valve retention member and the cylinder member can be miniaturized and light-weighted.

The fuel pump having the structure as defined in above (2) may preferably be so constructed that (3) the first insertion hole of the outer shell member has the valve retention member received therein and the second insertion hole of the outer shell member has the cylinder member received therein. By the construction as described above, the fuel passage including a suction side fuel passage and a discharge side fuel passage of the fuel pressurizing chamber can be linearly formed in the valve retention member, as well as the plurality of valve elements can be linearly disposed in the valve retention member, thereby making it possible to improve a workability of parts machining and assembling.

The fuel pump having the structure as defined in above (2), (3) may preferably be so constructed that (4) the outer shell member, the valve retention member and the cylinder member collectively constituting the fuel storage chamber to be surrounded by the inner wall surface of the outer shell member and the outer surface of a received portion formed by a part of each of the valve retention member and the cylinder member received in the first insertion hole and the second insertion hole of the outer shell member. By the construction as described above, the outer shell member can support the valve retention member and the cylinder member, to have the support rigidity increased, so that the supporting structure of the valve retention member and the cylinder member can be miniaturized and light-weighted.

The fuel pump having the structure as defined in above (1) to (4) may preferably be so constructed that (5) the valve retention member has a valve accommodation hole formed therein, the valve accommodation hole axially aligning and accommodating the plurality of the valve elements therein. By the construction as described above, a plurality of valve elements can be accommodated in a single valve retention member, thereby facilitating the assembly work of the fuel pump.

The fuel pump having the structure as defined in above (1) to (5) may preferably be so constructed that (6) the outer shell member has a peripheral wall portion, a first closing portion, and a second closing portion, the peripheral wall portion having the first insertion holes formed therein, the first closing portion being arranged to close one end portion in an axial direction of the peripheral wall portion, the second closing portion being arranged to close the other end portion in the axial direction of the peripheral wall portion and having the second insertion hole formed therein. By the construction as described above, a diameter dimension and a height dimension of the fuel storage chamber can be suppressed, while securing a sufficient space of the fuel storage chamber forming an inner chamber of the outer shell member, thereby making it possible to provide a compact fuel pump.

The fuel pump having the structure as defined in above (6) may preferably be so constructed that (7) the outer shell member has a resilient film member arranged therein, the resilient film member being arranged in the vicinity of the first closing portion and receives a pressure of the fuel stored in the fuel storage chamber. By the construction as described above, even if, for example, there is occurred a pulsation of the fuel pressure in the suction side of the fuel passage due to an intermittent fuel consumption or a fuel supply pressure fluctuation in an upstream side, the pulsation can be absorbed.

The fuel pump having the structure as defined in above (1) to (7) may preferably be so constructed that (8) the fuel pressurizing chamber is formed by the plunger and at least either one of the valve retention member and the cylinder member. By the construction as described above, rigidity and sealing property of the pump body can be effectively enhanced within a small area in the vicinity of the fuel pressurizing chamber, thereby contributing to weight saving and cost reduction.

The fuel pump having the structure as defined in above (8) may preferably be so constructed that (9) the valve retention member is formed by a tubular body penetrating through the outer shell, the cylinder member is connected with the valve retention member in the outer shell member, and the fuel pressurizing chamber is formed by the valve retention member, the cylinder member and the plunger. By the construction as described above, an inner end side of the cylinder member can be closed by the valve retention member, so that a shape of the cylinder member can be further simplified.

The fuel pump having the structure as defined in above (9) may preferably be so constructed that (10) the valve retention member has a pair of valve retention tubular portions and an intermediate tubular portion, the pair of valve retention tubular portions being spaced apart from each other in a suction side and a discharge side of the fuel pressurizing chamber and facing each other in an axial direction, the intermediate tubular portion being disposed between the pair of valve retention tabular portions and connected with the cylinder member, and the fuel pressurizing chamber is formed by the intermediate tubular portion of the valve retention member, the cylinder member and the plunger. By the construction as described above, the intermediate tubular member can be assembled simultaneously with the pair of valve retention tubular portions being inserted, as well as simultaneously with the cylinder member being inserted.

The fuel pump having the structure as defined in above (8) may preferably be so constructed that (11) the valve retention member is constituted by a tubular body penetrating through the outer shell, the cylinder member is connected with the valve retention member in the outer shell member, and the fuel pressurizing chamber is formed by the cylinder member and the plunger. By the construction as described above, rigidity and sealing property of the pump body can be effectively enhanced within a small area in the vicinity of the fuel pressurizing chamber, thereby facilitating the machining of the valve retention member, eventually reducing the cost of parts machining.

The fuel pump having the structure as defined in above (11) may preferably be so constructed that (12) the valve retention member has a pair of valve retention tubular portions spaced apart from each other in a suction side and a discharge side of the fuel pressurizing chamber, facing each other in an axial direction, to retain the suction valve and the discharge valve, the cylinder member has a bottomed tubular body reciprocatably accommodating the plunger therein to be closed in an inner end side positioned inside of the outer shell member, the bottomed tubular body has a pair of communication holes formed in a peripheral wall portion thereof, the pair of communication holes respectively communicating with fuel passages of the pair of valve retention tubular portions. By the construction as described above, rigidity and sealing property of the pump body can be effectively enhanced within a small area in the vicinity of the fuel pressurizing chamber, thereby further facilitating the machining of the valve retention member.

The fuel pump having the structure as defined in above (1) to (12) may preferably be so constructed that (13) the valve retention member has a bypass passage and a relief valve formed therein, the bypass passage bypassing the discharge valve, the relief valve opening and closing the bypass passage, the relief valve being opened on the condition that a fuel pressure at a fuel discharge passage in a downstream side of the discharge valve in the fuel passage is higher than a fuel pressure at the fuel pressuring chamber by a predetermined value. By the construction as described above, the fuel pressure in the downstream side can be suppressed from being excessively increased.

The fuel pump having the structure as defined in above (13) may preferably be so constructed that (14) each of the suction valve and the relief valve has a valve seat and a valve body, the valve seat of the suction valve and the valve seat of the relief valve being supported by the valve retention member to be spaced apart from each other in an axial direction of the valve retention member, the valve body of the suction valve and the valve body of the relief valve being displaced in the axial direction of the valve retention member, the fuel pressurizing chamber has a plurality of resilient members arranged therein, the plurality of resilient members urging the valve body of the suction valve and the valve body of the relief valve in the axial direction of the valve. By the construction as described above, one or more members for forming the valve seat in the valve retention member and the resilient member for urging the valve body are easily arranged, as well as the parts machining can be facilitated. Here, the plurality of resilient members, for example, if constituted by compression coil springs respectively having differing effective diameters, can be compactly mounted.

Advantageous Effects of Invention

According to the present invention, the structure of the valve retention member, the cylinder member and the outer shell member can be simplified to a level of an axial shape such as a tubular shape or a bottomed tubular shape, so that an excess thickness of the pump body can be largely reduced to save the weight of the pump body, while making it possible to drastically facilitate the machining of the fuel passage, the fuel pressurizing chamber and the like. Furthermore, the fuel storage chamber can be formed by the outer surface of the valve retention member and the inner wall surface of the outer shell member located in the vicinity of the fuel pressurizing chamber, so that the fuel storage chamber adapted to store the fuel to be introduced into the pump body can be made large in volume, thereby making it possible to effectively control the pressure fluctuations of the fuel to be introduced into the fuel pressurizing chamber. As a consequence, the fuel pump according to the present invention can suppress an excess thickness and an increase in size of the structure of the pump body, so that the fuel pump is miniaturized and light-weighted, thereby making it possible to improve the productivity and lower the cost.

DESCRIPTION OF EMBODIMENTS

The preferred embodiment of the present embodiment will hereinafter be described with reference to the accompanying drawings.

An Embodiment

FIGS. 1 to 5 show a schematic construction of a fuel pump according to the embodiment of the present invention.

The fuel pump according to the present embodiment is a high-pressure fuel pump of plunger pump type, in which a fuel of an engine mounted on an automotive vehicle, for example a gasoline engine of in-cylinder injection type or dual-projection type (hereinafter simply referred to as "engine"), is sucked, pressurized and discharged by the construction as explained hereinafter. Further, although not shown, the fuel pump according to the present embodiment is connected to a delivery pipe adapted to supply the high pressure fuel, which is accumulated and stored in the delivery pipe, to a plurality of injectors (fuel injection valves) for in-cylinder injection.

Figure 1:
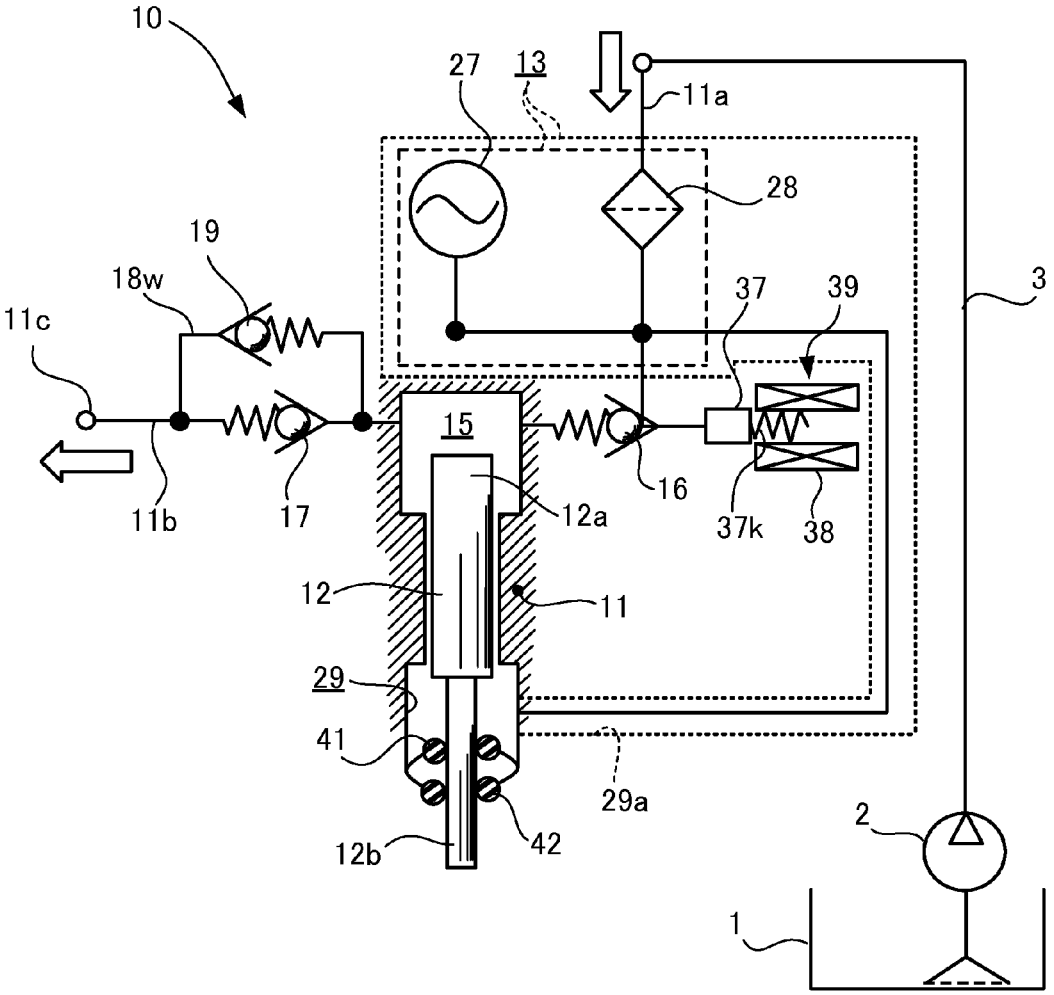
FIG. 1 is a schematic construction view of a fuel pump according to an embodiment of the present invention. The plurality of valve elements and the like are shown by hydraulic pressure circuit symbols.

As shown in FIG. 1 in a schematic view, a fuel pump 10 according to the present embodiment is connected to a feed pump 2 in a fuel tank 1 through a pipe 3, thereby making it possible to suck the fuel pressurized to a relatively low feed pressure. The feed pump 2, for example, of electricity-driven type, is adapted to pump up a gasoline, which constitutes the fuel in the tank 1.

The fuel pump 10, as shown in FIGS. 2 to 5, comprises a pump body 11 and a plunger 12 axially reciprocatably arranged with respect to the pump body 11. The pump body 11 has a suction passage 11*a* (a fuel passage in a suction side) and a discharge passage 11*b* (a fuel passage in a discharge side) formed therein, the suction passage 11*a* being adapted to suck the fuel from the feed pump 2, the discharge passage 11*b* being adapted to discharge the fuel pressurized in the pump body to the delivery pipe side not shown. The delivery pipe is constructed to store and accumulate the high-pressure fuel pressurized in and discharged from the fuel pump 10, thereby making it possible to distribute and supply the high-pressure fuel to the injector for in-cylinder injection when a valve of the injector disposed in each of the cylinders is opened.

Figure 5:
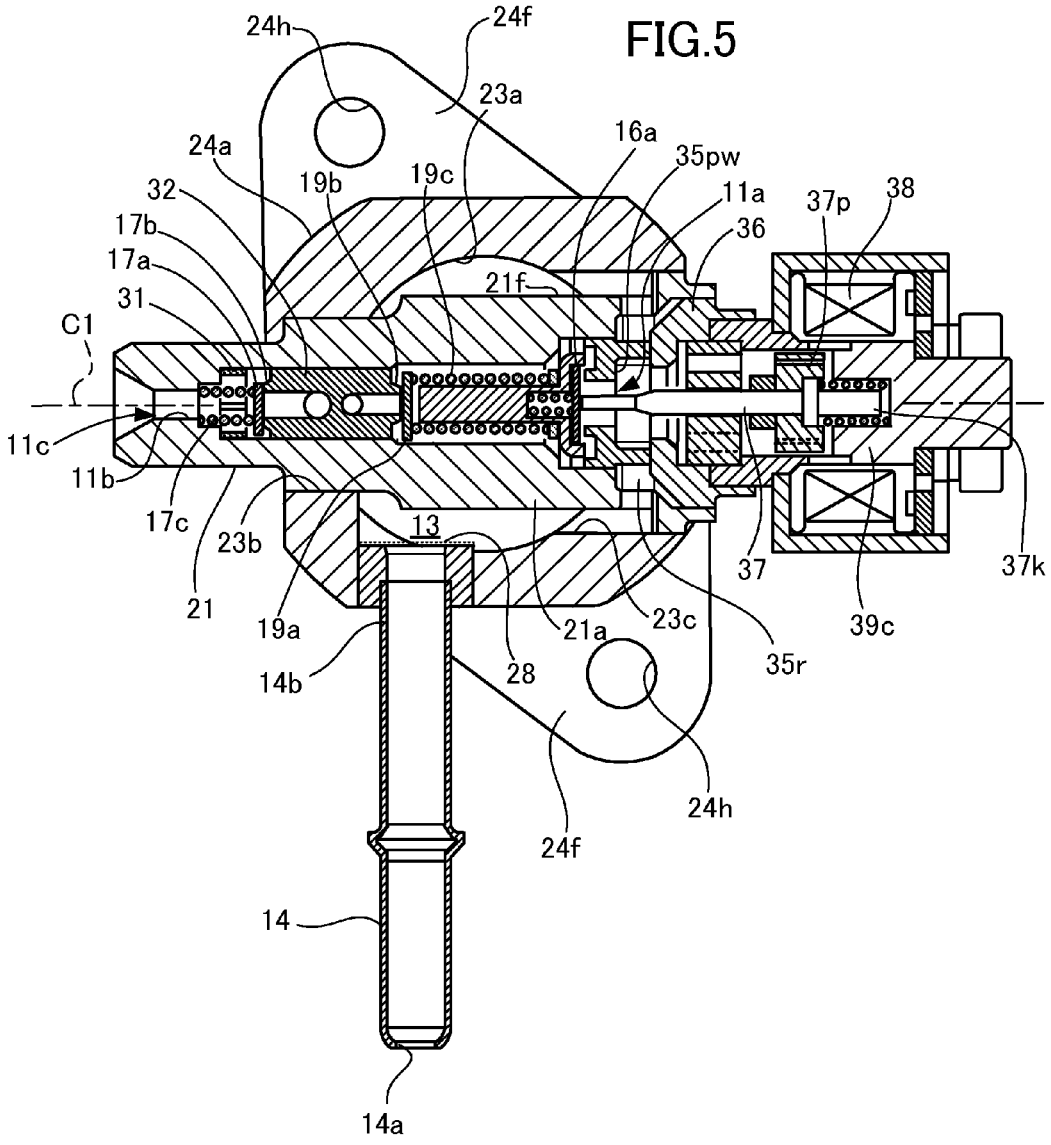
FIG. 5 is a cross-sectional view taken along the chain line and seen from the arrows V-V in FIG. 2.

As will be described hereinafter in detail, a part of the suction passage 11*a* is forming a suction gallery chamber 13 (a fuel storage chamber) in which the fuel from the feed pump 2 can be stored. Further, as shown in FIG. 5, the pump body 11 has a fuel introduction pipe portion 14 having a shape of an outwardly extending pipe formed thereon, the fuel introduction pipe portion 14 having a suction port 14*a* formed at a top end portion thereof. In the vicinity of a base end portion 14*b* of the fuel introduction pipe portion 14, forming an entry side of a suction gallery chamber 13, is disposed a fuel filter 28. Further, as shown in FIG. 1, the suction gallery chamber 13 is communicated with a sub chamber 29 through a communication passage 29*a*, so as to allow the fuel to move between the suction gallery chamber 13 and the sub chamber 29 in response to a reciprocation displacement of the plunger 12, the sub chamber 29 being formed between an outer end portion 12*b* (a bottom end portion of the plunger 12 as shown in FIG. 1) of the plunger 12 and the pump body 11.

The plunger 12 is slidably received in the pump body 11 by an inner end portion 12*a* (a top end portion of the plunger 12 as shown in FIG. 1). Between the plunger 12 and the pump body 11, inside of the pump body 11, is formed a fuel pressurizing chamber 15, connected to the suction passage 11*a* and the discharge passage 11*b*. The fuel pressurizing chamber 15 is adapted to vary (increase, decrease) the volume thereof in response to the reciprocation displacement of the plunger 12, thereby making it possible to suck and discharge the fuel.

Further, the plunger 12 is held in engagement with a drive cam not shown that drives the plunger 12 through a roller or the like at the outer end portion 12*b*. Still further, in the vicinity of the outer end portion 12*b* of the plunger 12 is arranged a spring receiving portion 12*c*, and between the spring receiving portion 12*c* and the pump body 11 is assembled a compressed coil spring 51 in a compressed state. This means that the plunger 12 is all the time urged by the compressed coil spring 51 in a direction (a downward direction in FIG. 1) to increase the volume of the fuel pressurizing chamber 15. Therefore, the plunger 12 is adapted to be reciprocated in response to a rotation of the drive cam, when the drive cam is rotated by a power of an engine.

On either side of the fuel pressurizing chamber 15, i.e. the suction side and the discharge side of the fuel pressurizing chamber 15, are provided a suction valve 16 and a discharge valve 17, as a plurality of valve elements, the suction valve 16 being constituted by a check valve which allows the fuel suction into the fuel pressurizing chamber 15 in the downstream side of the suction gallery chamber 13 and functions in prevention of a reverse flow, the discharge valve 17 being constituted by a check valve which allows the fuel discharge from the fuel pressurizing chamber 15 and functions in prevention of a reverse flow.

In response to the plunger 12 being displaced in an upward direction in FIG. 1, so that the volume of the fuel pressurizing chamber 15 be decreased, the fuel in the fuel pressurizing chamber 15 is pressurized to have the fuel pressure increased, thereby having the discharge valve 17 opened under the state of the suction valve 16 being closed. On the other hand, in response to the plunger 12 being displaced in a downward direction in FIG. 1, so that the volume of the fuel pressurizing chamber 15 be increased, the fuel in the fuel pressurizing chamber 15 is depressurized to have the fuel pressure decreased, thereby having the suction valve 16 opened under the state of the discharge valve 17 being closed.

Further, in the discharge side of the fuel pressurizing chamber 15, inside of the pump body 11, is formed a bypass passage 18*w* and a relief valve 19, the bypass passage 18*w* being adapted to bypass the discharge valve 17, and a relief valve 19, capable of opening and closing the bypass passage 18*w*, being provided as one of the plurality of the valve elements.

The relief valve 19 is adapted to be opened in response to the fuel pressure in the discharge passage 11*b* in the downstream side of the discharge valve 17 being higher than the fuel pressure in the fuel pressurizing chamber 15 by a predetermined relief valve opening pressure difference.

Figure 2:
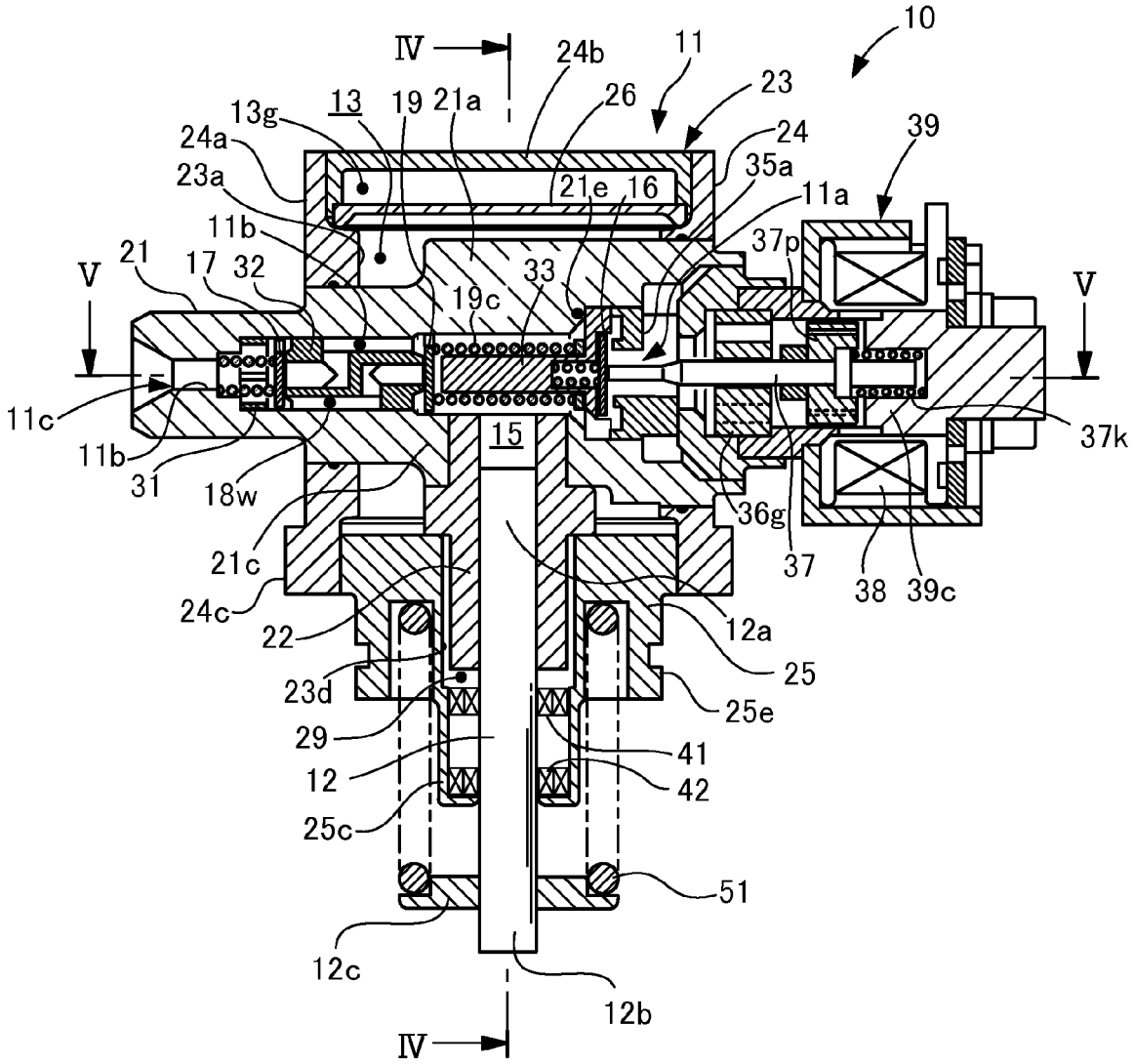
FIG. 2 is a front cross-sectional view of the fuel pump according to the embodiment of the present invention.
Figure 3:
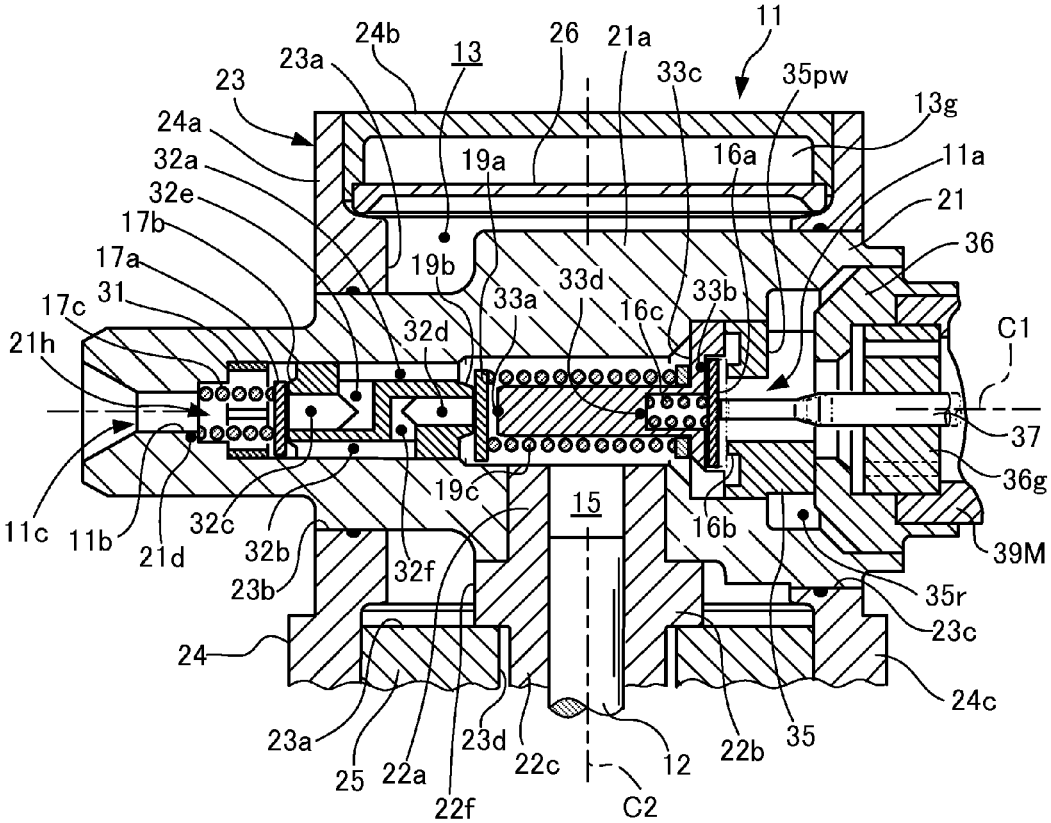
FIG. 3 is a partial enlarged cross-sectional view showing the essential part of the fuel pump as shown in FIG. 2.

As shown in FIG. 2 and FIG. 3, the suction valve 16 comprises a plate-shaped valve body 16*a*, an annular valve seat 16*b* and a preload spring 16*c* (a resilient member), the valve body 16*a* being adapted to open and close the suction passage 11*a*, the preload spring 16*c* being adapted to keep a closed valve state in which the valve body 16*a* is held in contact with the valve seat 16*b*, until a predetermined suction pressure (a pressure lower than a feed pressure by a predetermined suction valve opening pressure difference) is reached. On the other hand, the discharge valve 17 comprises a plate-shaped valve body 17*a*, an annular valve seat 17*b* and a preload spring 17*c* (a resilient member), the valve body 17*a* being adapted to open and close the discharge passage 11*b*, the preload spring 17*c* being adapted to keep a closed valve state in which the valve body 17*a* is held in contact with the valve seat 17*b*, until a predetermined discharge pressure (a pressure higher than the fuel pressure in a delivery pipe by a predetermined discharge valve opening pressure difference) is reached. Further, the relief valve 19 comprises a plate-shaped valve body 19*a*, an annular valve seat 19*b* and a preload spring 19*c* (a resilient member), the valve body 19*a* being adapted to open and close the bypass passage 18*w*, the preload spring 19*c* being adapted to keep a closed valve state in which the valve body 19*a* is held in contact with the valve seat 19*b*, until a pressure difference between one side of the valve body 19*a* and the other side of the valve body 19*a* is reached to a predetermined relief valve opening pressure difference in response to an increase of the fuel pressure in the discharge passage 11*b* or a decrease of the fuel pressure in the fuel pressurizing chamber 15. The plate-shaped valve bodies 17*a*, 19*a*, for example, respectively form a shape of an approximate circular plate shape having a cutout for forming a passage on an outer peripheral portion thereof.

On the other hand, in the present embodiment, the pump body 11 comprises a tubular valve retention member 21, a cylinder member 22 and an outer shell member 23, the cylinder member 22 constituting a tubular plunger retention member adapted to axially and slidably retain the plunger 12, the outer shell member 23 having an inner wall surface 23*a* formed therein, the inner wall surface 23*a* facing outer peripheral surfaces 21*f*, 22*f* (outer surface; details will be described hereinafter) of at least a part of the valve retention member 21 and the cylinder member 22. The valve retention member 21, the cylinder member 22 and the outer shell member 23, respectively have an approximately axially symmetrical shape, or symmetric with respect to a central axis line thereof, in a vertical sectional view at least in an internal wall surface side thereof, forming a shape of what is called a shaft member or a shape similar to a shaft member.

Figure 4:
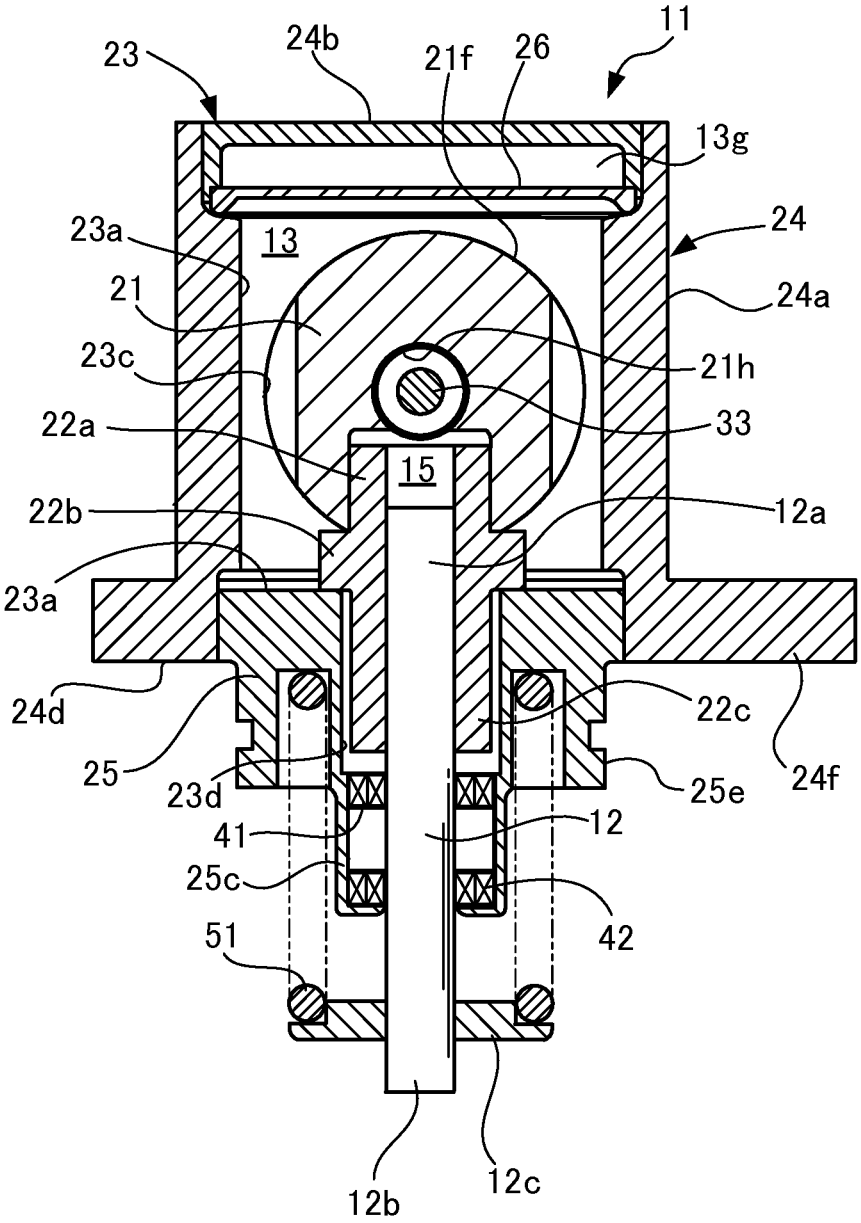
FIG. 4 is a cross-sectional view taken along the chain line and seen from the arrows IV-IV in FIG. 2.

The tubular valve retention member 21 has a stepped valve accommodation hole 21*h* and a stepped outer peripheral surface 21*f*, the valve accommodation hole 21*h* and the outer peripheral surface 21*f* axially extending in a center portion of the valve retention member 21 and having circular cross-sections with diameters increasing in a stepped manner toward the right end side in FIGS. 2 and 3 (See FIGS. 3 to 5). The valve retention member 21 accommodates the plurality of the valve elements, the suction valve 16, the discharge valve 17 and the relief valve 19, therein. The suction valve 16, the discharge valve 17 and the relief valve 19 are retained by the valve retention member 21 in a linearly aligned manner to be coaxially positioned.

Specifically, the valve retention member 21 has a downstream side exit 11*c* of the discharge passage 11*b* formed at a left end portion thereof in FIG. 3, the downstream side exit 11*c* positioned at an innermost position of the stepped valve accommodation hole 21*h*. Further, as shown in FIG. 2, the valve accommodation hole 21 of the valve retention member 21 has a first valve stopper 31, a second valve stopper 32, a third valve stopper 33, the discharge valve 17, the relief valve 19 and the suction valve 16 accommodated therein.

The first valve stopper 31 is an annular shaped body with a slit fitted in the inner portion of the valve accommodating hole 21*h* of the valve retention member 21, and is adapted to regulate a maximum displacement of the valve body 17*a* of the discharge valve 17 in a direction to open the discharge valve 17.

The second valve stopper 32 constitutes two passage forming members with a bent passage forming a part of the discharge passage 11*b* and the bypass passage 18*w*. This means that the second valve stopper 32 has a pair of longitudinal grooves 32*a*, 32*b* formed on an outer peripheral side thereof, a pair of longitudinal bores 32*c*, 32*d* formed at a predetermined depth thereof and a pair of lateral bores (diametrical bores) 32*e*, 32*f* formed therein, the longitudinal bores 32*c*, 32*d* being adapted to open at a central portion of the axial both ends of the second valve stopper 32 and formed at a predetermined depth, the lateral bores 32*e*, 32*f* having the longitudinal grooves 32*a*, 32*b*, held in communication with the longitudinal bores 32*c*, 32*d*, respectively.

The second valve stopper 32 has the valve seat 17*b* of the discharge valve 17 formed at one end side thereof, from which the valve seat 17*b* is axially and annularly extending, while the second valve stopper 32 has the valve seat 19*b* of the relief valve 19 formed at the other end side thereof, from which the valve seat 19*b* is axially and annularly extending. The valve body 17*a* of the discharge valve 17 and the valve body 19*a* of the relief valve 19 are respectively held in face-to-face relationship with the valve seat 17*b* and the valve seat 19*b* at the both end sides of the second valve stopper 32. Further, the preload spring 17*c* of the discharge valve 17 is assembled between a stepped portion 21*d* of the valve retention member 21 in the innermost side of the valve accommodating hole 21*h* and the valve body 17*a* of the discharge valve 17, with an assembling load equivalent to a predetermined discharge valve opening pressure difference.

The third valve stopper 33 is constituted by a member, having an approximately T-shaped cross-section, integrated by radially arranging stopper portions 33*a*, 33*b* and spring retention portions 33*c*, 33*d* corresponding to the relief valve 19 and the suction valve 16 in an opposite direction. The third valve stopper 33 thus constructed has functions: a function of a stopper to regulate a movable range of the valve body 16*a* and the valve body 19*a* and a function of a spring retainer. Further, the preload spring 19*c* of the relief valve 19 is assembled between the valve body 19*a* of the relief valve 19 and the spring retention portion 33*c* of the third valve stopper 33 with an assembling load equivalent to a predetermined relief valve opening pressure difference, while the preload spring 16*c* of the suction valve 16 is assembled between the valve body 16*a* of the suction valve 16 and the spring retention portion 33*d* of the third valve stopper 33 with an assembling load equivalent to a predetermined suction valve opening pressure difference.

The third valve stopper 33 is held in face-to-face relationship with a passage forming member 35, arranged in an outer peripheral portion of the spring retention portion 33*c* shown in a right end side of FIG. 3, constituting the annular valve seat 16*b* of the suction valve 16. The outer peripheral portion of the spring retention portion 33*c* is constructed to be partially cut out, so that the fuel pressurizing chamber 15 is communicated with a vicinity of the valve seat 16*b* of the suction valve 16. The passage forming member 35 is forming a communication passage 35*pw*, extending in the valve retention member 21 from the suction gallery chamber 13 to the fuel pressurizing chamber 15, as a part of the suction passage 11*a*. Further, the valve seat 16*b* of the suction valve 16, being constituted by one end portion of the passage forming member 35, is axially annularly extending toward the side of the fuel pressurizing chamber 15, surrounding a downstream end of the communication passage 35*pw*.

The passage forming member 35 is retained by a plug member 36, having an operation member 37 attached therein, in a state of being pressed against a stepped portion 21*e* of the valve retention member 21 together with the stopper portion 33*b* of the third valve stopper 33. The plug member 36 is, for example, connected with a screw to a right end portion of the valve retention member 21 in FIG. 3. Further, between the passage forming member 35, the plug member 36 and the vicinity of the stepped portion 21*e* of valve retention member 21 is formed an annular communication passage portion 35*r* as a part of a communication passage 35*pw*, the annular communication passage portion 35*r* held in communication with the suction gallery chamber 13 at a plurality of positions. By the construction as described above, on the side of the valve seat 16*b* of the suction valve 16, the communication passage 35*pw* axially extends at a central portion of the valve retention member 21 to be opened toward an inner side of the valve seat 16*b*, while on the side of the suction gallery chamber 13, the communication passage 35*pw* extends radially and circumferentially of the passage forming member 35 to be opened on the outer peripheral surface 21*f* of the valve retention member 21 in the suction gallery chamber 13.

The operation member 37 is slidably supported by a guide portion 36*g* of the plug member 36. The operation member 37 is adapted to press the valve body 16*a* of the suction valve 16 in a direction to open the suction valve 16 (leftward direction in FIG. 2 and FIG. 3), against an urging force of the preload spring 16*c* urging the valve body 16*a* in a direction to close the suction valve 16, so that the suction valve 16 be opened.

The operation member 37 constitutes an operating plunger (movable core) received in an electromagnetic coil 38 at a right end side of FIG. 2, so that the operation member 37 is pulled into the electromagnetic coil 38 when the electromagnetic coil 38 is excited by being energized. Therefore, when the electromagnetic coil 38 is excited by being energized (in ON state), the valve body 16*a* of the suction valve 16 is adapted to be returned in the direction to open the suction valve 16 by an urging force of the preload spring 16*c*. The operation member 37 and the electromagnetic coil 38 as a whole constitute an electromagnetic operation unit 39. The electromagnetic operation unit 39 can control a period to forcefully open the suction valve 16, thereby making it possible to variably control a pressurizing period to pressurize a fuel in the fuel pressurizing chamber 15 by the plunger 12.

To be more specific, in a base end side of the operation member 37 is provided a plunger portion 37*p* having a diameter approximately equal to an inner diameter of the electromagnetic coil 38, while in a side of a body 39M of an electromagnetic operation unit 39 accommodating the electromagnetic coil 38 is provided a stator core 39*c* held in a face-to-face relationship with the plunger portion 37*p*. Between the base end portion of the operation member 37 and the stator core 39*c* is provided a compressed coil spring 37*k* (resilient member) in a compressed state, the coil spring 37*k* being adapted to urge the operation member 37 in the direction to open the suction valve 16. An assembling load of the coil spring 37*k* is so set forth that the suction valve 16 be opened against the urging forth of the preload spring 16*c* urging the valve body 16*a* in the direction to close the suction valve 16, by adding an urging force in the direction to open the suction valve 16 to the urging force in the direction to open the suction valve 16 based on a differential pressure across the valve body 16*a* of the suction valve 16.

As shown in FIG. 3 and FIG. 4, the cylinder member 22 of the pump body 11 is supported by the valve retention member 21 at an inner end portion of the cylinder member 22. The cylinder member 22 has an insertion portion 22*a*, a flange portion 22*b* and a tubular portion 22*c* formed therein, the insertion portion 22*a* being received in an axial intermediate portion 21*c* of the tubular valve retention member 21, the flange portion 22*b* being arranged adjacent to the insertion portion 22*a* to have an outer peripheral surface 22*f* with a diameter larger than the diameter of the insertion portion 22*a*, the tubular portion 22*c* having a top end portion of the plunger 12 slidably accommodated therein. Here, the insertion portion 22*a* of the cylinder member 22 may be secured to the valve retention member 21 by any known method of securing (press fitting, caulking, welding, screwing, diffusion bonding or the like or any combination thereof).

Further, the outer shell member 23 of the pump body 11 is constituted by a cup-shaped member 24 and an oil seal holder 25 (second closing portion), the cup-shaped member 24 being formed by having an approximately tubular-shaped tubular portion 24*a* closed by an approximately circular plate-shaped lid portion 24*b* (first closing portion) at one end side of the cup-shaped member 24, the oil seal holder 25 having a central hole formed therein and being secured to the cup-shaped member 24 to close an open end side 24*c* of the cup-shaped member 24 while press-contacting the cylinder member 22. Furthermore, the cup-shaped member 24 has the flange portion 24*f* integrally therewith, the flange portion 24*f* having an attachment base surface 24*d* and an attachment hole 24*h* arranged therein. Still further, the oil seal holder 25 has an oil seal holding portion 25*c* and an attachment boss portion 25*e* arranged therein, the oil seal holding portion 25*c* being adapted to hold a plurality of oil seals 41, 42 on a double-row basis, the plurality of oil seals 41, 42 being held in engagement with the plunger 12, the attachment boss portion 25*e* being adapted to surround an end portion of the compression coil spring 51 and arranged coaxially with the plunger 12 to be approximately tubular in shape.

The valve retention member 21, the cylinder member 22, the cup-shaped member 24 and the oil seal holder 25 are respectively manufactured, for example, through preliminarily molding metal material into a material shape model close to a final shape, and thereafter performing machining work on fitting portions with other members, sliding portions, attachment surfaces and the like. The valve retention member 21, the cylinder member 22, the cup-shaped member and the oil seal holder 25 may of course be constituted by a shaft member simply having metal materials lathed by a general-purpose lathe.

The outer shell member 23 has the valve retention member 21 and the cylinder member 22 received therein, so that the valve retention member 21 and the cylinder member 22 are penetrating through the inner wall surface 23*a* and having the axes orthogonally crossed with each other. The outer shell member 23 has the suction gallery chamber 13 formed between the insertion unit 21*a* of the valve retention member 21 and the flange portion 22*b* (insertion portion) of the cylinder member 22, the valve retention member 21 being received in an inner space, approximately in a cylindrical shape, of the outer shell member 23, the suction gallery chamber 13 constituting a fuel storage chamber and communicating with the suction passage 11*a* in the upstream side of the suction valve 16. For securing the valve retention member 21 to the outer shell member 23 and for securing the oil seal holder 25 to the outer shell member 23, any known method of securing (press fitting, caulking, welding, screwing, diffusion bonding or the like or any combination thereof) may be employed.

To be more specific, as shown in FIGS. 3 to 5, the outer shell member 23 has a pair of first insertion holes 23*b*, 23*c* and a second insertion hole 23*d* formed therein, the pair of first insertion holes 23*b*, 23*c* penetrating the inner wall surface 23*a* in the same direction, the second insertion hole 23*d* having, for example, an axis line C2 orthogonally crossing with respect to axis lines C1 of the pair of first insertion holes 23*b*, 23*c*. The pair of first insertion holes 23*b*, 23*c*, which is one of the pair of first insertion holes 23*b*, 23*c* and the second insertion hole 23*d*, may have the valve retention member 21 received therein, while the second insertion hole 23*d*, which is the other of the pair of first insertion holes 23*b*, 23*c* and the second insertion hole 23*d*, may have the cylinder member 22 received therein.

Further, each of the first insertion holes 23*b*, 23*c* of the outer shell member 23 differ from each other in length of inner diameter. The inner diameter of the first insertion hole 23*b* is smaller than the inner diameter of the first insertion hole 23*c*, the first insertion hole 23*b* being positioned at front end side in insertion direction of the valve retention member 21, the first insertion hole 23*c* being positioned at rear end side in insertion direction of the valve retention member 21.

As will be understood from the foregoing description, the outer shell member 23 is constituted by an approximately tubular-shaped tubular portion 24*a* (peripheral wall portion) of the cup-shaped member 24, a lid portion 24*b* (first closing portion) and the oil seal holder 25 (second closing portion), the tubular portion 24*a* having the first insertion holes 23*b*, 23*c* formed therein, the lid portion 24*b* closing a one axially end side of the tubular portion 24*a*, the oil seal holder 25 closing the other axially end side of the tubular portion 24*a* and having the second insertion hole 23*d* formed therein.

Further, the outer shell member 23 has a resilient film member 26 provided therein, so that the resilient film member 26, adapted to receive a pressure of the fuel stored in the suction gallery chamber 13, approaches the lid portion 24*b* spaced apart from the resilient film member 26 by a predetermined gap 13*g*. The resilient film member 26 is adapted to have a part of an inner wall of the suction gallery chamber 13 provided with resiliency, to constitute what is called a pulsation damper 27, thereby making it possible to absorb a pulsation of the fuel pressure in the suction passage 11*a*.

Meanwhile, the fuel pressurizing chamber 15 is constituted by the plunger 12 and at last either one of the insertion unit 21*a* and the like of the valve retention member 21 and the cylinder member 22.

In the present embodiment, the valve retention member 21 is constituted to be a tubular body thoroughly penetrating through the outer shell member 23, while the insertion portion 22*a* and the flange portion 22*b* (hereinafter referred to as "insertion unit 21*a* and the like") of the cylinder member 22, collectively constituting an insertion portion of the cylinder member 22, is connected to the insertion unit 21*a* of the valve retention member 21 in the outer shell member 23. Further, the fuel pressurizing chamber 15 is formed by the plunger 12 and the insertion unit 21*a* and the like of the valve retention member 21 and the cylinder member 22.

As shown in FIGS. 2 to 5, in the present embodiment, the suction gallery chamber 13 is formed at a location in the outer shell member 23 and around the insertion unit 21*a* and the like of the valve retention unit 21 and the cylinder member 22. The plunger 12 and the insertion unit 21*a* and the like of the valve retention unit 21 and the cylinder member 22 collectively constitute the fuel pressurizing chamber 15. This means that the outer shell member 23, the valve retention member 21 and the cylinder member 22 constitute the fuel storage chamber 13 by the inner wall surface 23*a* of the outer shell member 23 and the outer peripheral surfaces 21*f*, 22*f* (outer surface) of each of the insertion unit 21*a* and the like, the inner wall surface 23*a* of the outer shell member 23 being held in face-to-face relationship with the outer peripheral surfaces 21*f*, 22*f* (outer surface) of the valve retention member 21 and the cylinder member 22, the insertion unit 21*a* and the like being received in the outer shell member 23.

Therefore, the suction gallery chamber 13 is so constructed to have the fuel storage volume relatively larger at axial both ends in the outer shell member 23, and the resilient film member 26 is disposed at an upper end side (one end side) of the suction gallery chamber 13, while a pipe-shaped fuel introduction pipe portion 14 is disposed at a lower end side (other end side) of the suction gallery chamber 13. Further, the fuel introduction pipe portion 14 is so directed that the fuel introduced into the suction gallery chamber 13 is allowed to flow circumferentially along the inner wall surface 23*a* of the outer shell member 23.

The aforementioned electromagnetic operation unit 39 is constructed to have energization thereof controlled by an ECU not shown, when a drive cam of the fuel pump 10 is driven by a motive power of an engine during an operation of the engine, so that a lift amount of the plunger 12 is periodically varied. This means that the ECU not shown is adapted to periodically calculate a required amount of fuel to supplement a fuel reduction in a delivery pipe and a fuel pressure reduction due to fuel injections, so that the electromagnetic coil 38 is energized by the ECU for a period of pressurization and discharge tantamount to the required amount of fuel, during a period in which the lift amount of the plunger 12 is increased (a period in which the fuel can be pressurized).

During the period in which the electromagnetic coil 38 of the electromagnetic operation unit 39 is energized as described above, the operation member 37 is pulled toward the electromagnetic coil 38, against the urging force of the compressed coil spring 37*k* working in the direction to open the suction valve 16, so that a pressing load in the direction to open the suction valve 16 is removed, thereby making it possible to close the suction valve 16.

Figure 6:
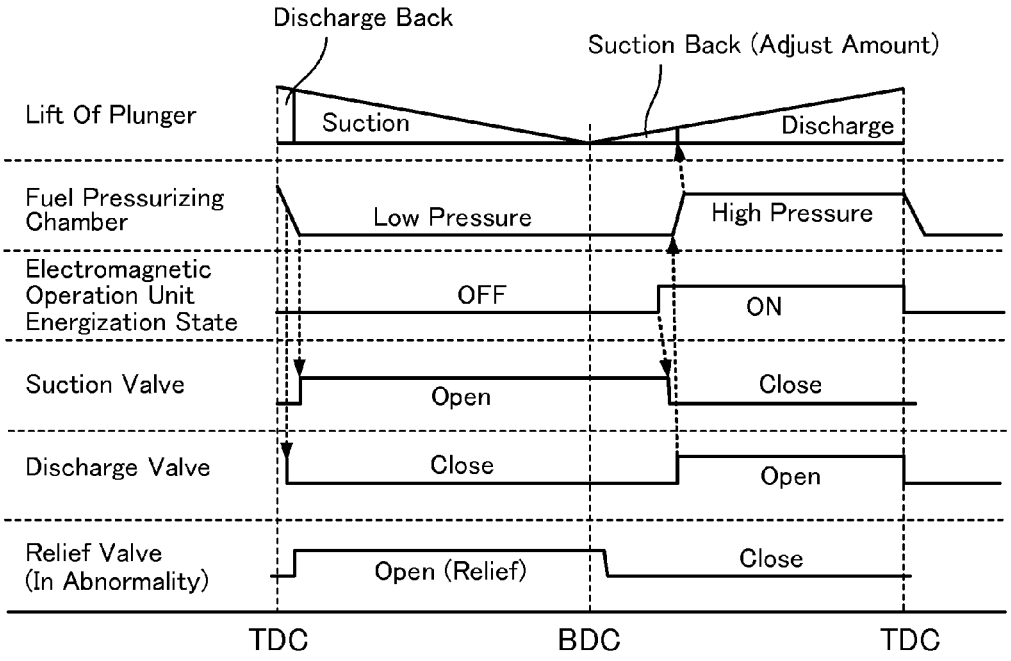
FIG. 6 is a view showing operations of the fuel pump according to the embodiment of the present invention.

As shown in FIG. 6, the fuel pump according to the present invention is so constructed that, during a period in which the suction valve 16 is closed, the lift amount of the plunger 12 is increased and the volume of the fuel pressurizing chamber 15 is decreased, so that the fuel pressure in the fuel pressurizing chamber 15 is pressurized from a fuel pressure level of a feed pressure up to a sufficiently high fuel pressure level, for example, up to 4-13 MPa, thereby making it possible to push open the discharge valve 17, with the result that the fuel in the fuel pressurizing chamber 15 is pumped to the delivery pipe. Here, "TDC" in FIG. 6 indicates a top dead center position (maximum lift position) of the plunger 12, while "BDC" in FIG. 6 indicates a bottom dead center position (minimum lift position) of the plunger 12.

On the other hand, during a period in which the suction valve 16 is not closed, energization of the electromagnetic coil 38 is shut off by the ECU (energization state OFF in FIG. 6), so that the urging force of the compressed coil spring 37*k* in the direction to open the suction valve 16 is acted upon the operation member 37 of the electromagnetic operation unit 39, so that the suction valve 16 is opened by function of a pressing force of the operation member 37. As shown in FIG. 6, the suction valve 16 is adapted to be opened when the fuel pressure in the fuel pressurizing chamber 15 is decreased, while the discharge valve 17 is adapted to be closed halfway through the decreasing process of the fuel pressure in the fuel pressurizing chamber 15, prior to the suction valve 16 thus being opened. During the period in which the suction valve 16 is opened, the fuel is sucked into the fuel pressurizing chamber 15, when the lift amount of the plunger 12 is decreased in response to a rotation of the drive cam, so that the volume of the fuel pressurizing chamber 15 is increased. However, on the other hand, when the lift amount of the plunger 12 is increased in response to a rotation of the drive cam, so that the volume of the fuel pressurizing chamber 15 is decreased, the fuel in the fuel pressurizing chamber 15 is leaked into the side of the suction passage 11*a*, thereby bringing about a state in which the fuel pressurizing chamber 15 is not pressurized up to the sufficiently high fuel pressure level (non-pressurized state).

The relief valve 19 is adapted to be opened, when the fuel pressure in the fuel pressurizing chamber 15 reaches a predetermined low pressure, for example, a negative pressure level having an absolute value which exceeds a predetermined value, under a state that the fuel pressure of the delivery pipe side is reached to a predetermined accumulation pressure level, so that a differential pressure across the relief valve 19 is reached to the predetermined relief valve opening pressure difference. The relief valve opening pressure difference may be set to a value exceeding a normal differential pressure across the relief valve 19 or a level of the relief valve opening pressure difference normally generated during a suction of the fuel, so that the relief valve opening pressure difference may be generated when there is occurred an abnormality in a supply system of injected fuel.

Further, the communication passage 29*a*, communicating the suction gallery chamber 13 and the sub chamber 29, may be formed, for example, between the cylinder member 22 and the oil seal holder 25 by partially cutting out either one of the cylinder member 22 and the oil seal holder 25. The communication passage 29*a* may otherwise be formed by a space between the cylinder member 22 and the oil seal holder 25, provided that there is a very small variation of an occupation volume of the plunger 12 in the sub chamber 29.

Next, the operation of the fuel pump according to the present invention will be explained hereinafter.

In the fuel pump according to the embodiment constructed as explained thus far, the valve retention member 21, the cylinder member 22 and the outer shell member 23, collectively constituting the pump body 11, can respectively be simplified in shape to a level of an approximately axially symmetric shape such as a tubular shape or a bottomed tubular shape. Therefore, each of the members constituting the pump body 11 can be easily manufactured into a form close to a final form by molding, so that machining works on the members, such as for example, hole machining and the like are drastically facilitated to a level of machinery works, such as for example, a machinery work of orthogonal two-directional machinery works or single axis machinery works by general purpose manufacturing machines. As a consequence, excess thickness of the pump body 11 can be drastically reduced to realize weight saving of the pump body 11 and machinery works for forming fuel passages, such as for example, the suction passage 11*a* and the discharge passage 11*b*, the fuel pressurizing chamber 15 and the like is greatly facilitated, thereby making it possible to improve the manufacturing productivity of the fuel pump even in the case of small-lot production.

In an operation of an engine having mounted thereon the fuel pump according to the present embodiment, there is a possibility to have a pulsation of fuel pressure on the side of the suction passage 11*a*, due to intermittent fuel suctions from the suction passage 11*a* to the fuel pressurizing chamber 15 or fluctuation of discharge pressure at the feed pump 2. However, in the present embodiment, the valve retention member 21 and the cylinder member 22, disposed in the vicinity of the fuel pressurizing chamber 15, have the insertion unit 21*a* or the like, and between the insertion unit 21*a* or the like and the outer shell member 23 is formed the suction gallery chamber 13 of comparatively large volume, the suction gallery chamber 13 being adapted to store the fuel in an upstream side of the suction valve 16. Further, the suction gallery chamber 13 and the resilient film member 26 collectively constitute the pulsation damper 27. Accordingly, the fuel pump according to the present embodiment can reliably absorb the fuel pressure pulsation in the side of the suction passage 11*a*, thereby making it possible to effectively suppress the pressure fluctuations of the fuels introduced into the fuel pressurizing chamber 15.

Moreover, the fuel pump according to the present embodiment can provide a compact fuel pump 10 by suppressing the size of diameter and height, while securing a sufficient volume of the suction gallery chamber 13 of the outer shell member 23, the suction gallery chamber 13 constituting an inner chamber of the outer shell member 23. Therefore, the fuel pump according to the present embodiment can drastically save weight of the fuel pump 10 and improve the properties such as suction efficiency.

Further, in the present embodiment, either one of the valve retention member 21 and the cylinder member 22 can be supported at both ends by the outer shell member 23, so that the support rigidity is enhanced, thereby making it possible to miniaturize and save weight of the support mechanism of the valve retention member 21 and the cylinder member 22.

Furthermore, the fuel pump according to the present embodiment can linearly form a part of the suction passage 11*a* and the discharge passage 11*b* (the suction side passage and the discharge side passage of the fuel pressurizing chamber 15) in the valve retention member 21 and linearly dispose the plurality of the valve elements, inclusive of the suction valve 16, the discharge valve 17 and the relief valve 19, in the valve retention member 21, thereby making it possible to drastically facilitate the machining and attachment of each of the parts. Especially, in the present embodiment, by simply having the suction valve 16, the discharge valve 17 and the relief valve 19 in the valve accommodation hole 21*h* of the valve retention member 21, the plurality of valve elements can be coaxially positioned (linearly disposed), thereby making it possible to facilitate an assembly of the fuel pump 10.

In addition, each the pair of the first insertion holes 23*b*, 23*c* of the outer shell member 23 differs in size of inner diameter from each other, so that the pair of the first insertion holes 23*b*, 23*c* of the outer shell member 23 can be simultaneously machined in an axially identical high precision and the valve retention member 21 can be easily inserted with respect to the first insertion holes 23*b*, 23*c* from the side of the first insertion hole 23*c* having a greater diameter than the first insertion hole 23*b*, thereby making it easy to improve a workability of an assembly work to have the valve retention member 21 radially penetrated through the outer shell member 23.

Further, in the fuel pump in the present embodiment, the fuel pressurizing chamber 15 is formed by the plunger 12 and the insertion unit 21*a* and the like of at least one of the valve retention member 21 and the cylinder member 22, so that the rigidity and sealing property of the pump body 11 can be effectively enhanced in a narrow scope in the vicinity of the fuel pressurizing chamber 15, thereby making it possible to have advantages in weight saving and cost reduction of the fuel pump 10. Furthermore, an inner side end of the cylinder member 22 can be closed and supported by the valve retention member 21, so that a shape of the cylinder member 22 can be simplified while enhancing the support rigidity thereof.

Still further, the relief valve 19, capable of opening and closing the bypass passage 18*w* in the valve retention member 21, is adapted to be opened only when the fuel pressure in the discharge passage 11*b* in the downstream side of the discharge valve 17 becomes greater than the fuel pressure in the fuel pressurizing chamber 15 by the predetermined relief valve opening pressure difference, thereby making it possible to suppress the fuel pressure in the downstream side from becoming excessively high.

In addition, the suction valve 16 and the relief valve 19 are respectively constituted by the valve seats 16*b*, 19*b*, spacing apart from each other in axial alignment of the valve retention member 21, and the valve bodies 16*a*, 19*a*, each being displaceable coaxially of the valve retention member 21, and the fuel pressurizing chamber 15 has disposed therein the plurality of preload springs 16*c*, 19*c*, respectively urging the valve bodies 16*a*, 19*a* in an axial direction, so that members 32, 35, respectively forming the valve seats 16*b*, 19*b* in the valve retention member 21, and the preload springs 16*c*, 19*c*, respectively arranged for urging the valve bodies 16*a*, 19*a*, can easily be arranged and machined.

As will be understood from the foregoing description, in the fuel pump in the present embodiment, a shape of each of the valve retention member 21, the cylinder member 22 and the outer shell member 23 can be simplified to a level of tubular shape or bottomed tubular shape, the weight of the pump body 11 can be saved through largely reducing the excess thickness of the pump body 11, and the machinery of the fuel passages, fuel pressurizing chamber 15 and the like can be drastically facilitated. Still more, the suction gallery chamber 13 having a relatively large volume, adapted to store the fuel in the upstream side of the suction valve 16, can be formed between the insertion unit and the outer shell member 23, the insertion unit forming part of the valve retention member 21 and the cylinder member 22 positioned in the vicinity of the fuel pressurizing chamber 15, thereby making it possible to effectively suppress the fuel pressure fluctuations of the fuel to be introduced into the fuel pressurizing chamber 15. As a result, excess thickness and increase in size of the structure of the pump body 11 can be suppressed, thereby making it possible to provide a miniaturized and weight-saved fuel pump which is of high productivity and low cost.

In the embodiment described above, the explanation has been directed to the fuel pump in which the outer shell member 23 of the pump body 11 is constituted by the cup-shaped member 24 and the oil seal holder 25, the cup-shaped member 24 being formed by the tubular portion 24*a* and the lid portion 24*b* closing one end side of the tubular portion 24*a*, the oil seal holder 25 being adapted to close the open end side 24*c* of the cup-shaped member 24 while press-contacting the cylinder member 22. However, the outer shell member 23 may otherwise be constructed in a different structure than the construction described above.

Figure 7:
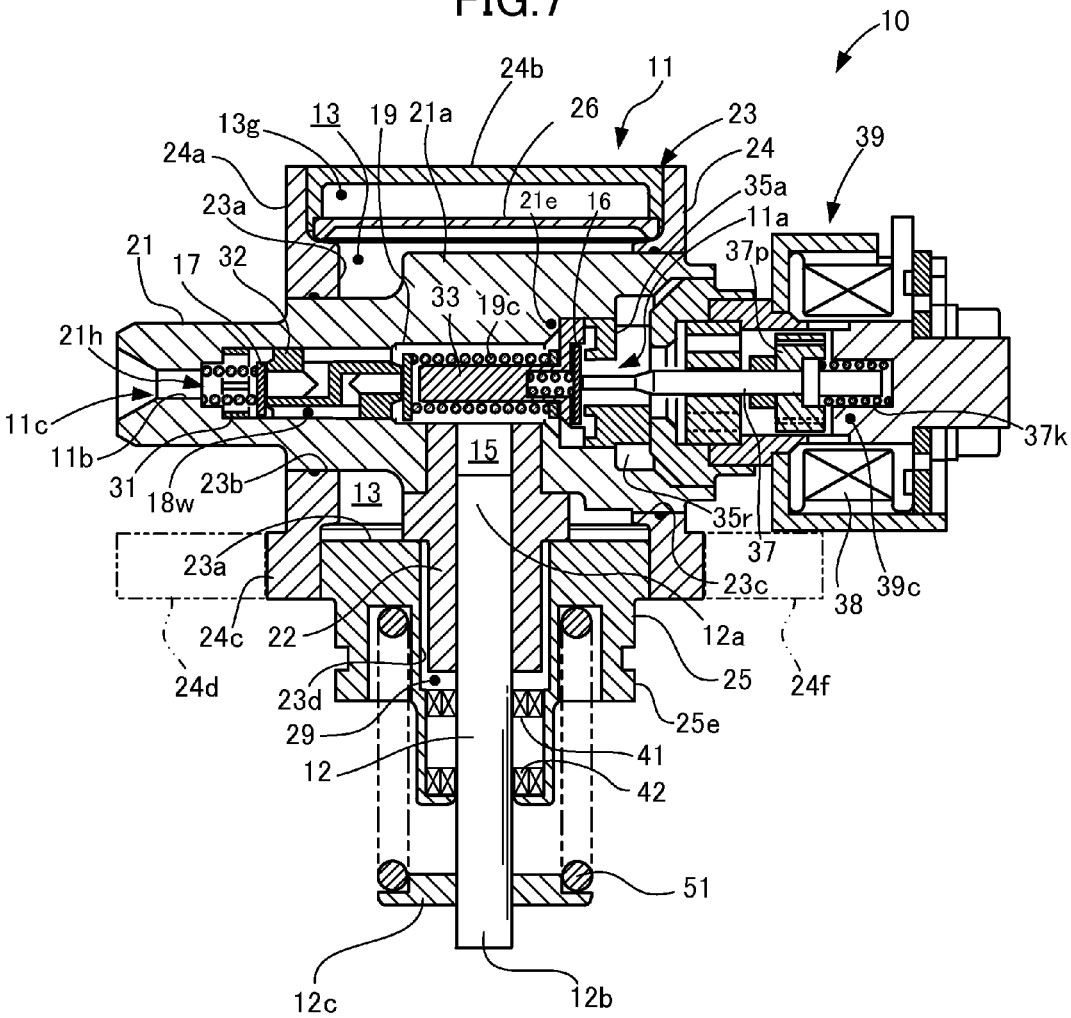
FIG. 7 is a front cross-sectional view showing a deformed state of the pump body of the fuel pump according to the embodiment of the present invention.

For example, the outer shell member 23 may be so constructed that the flange portion 24*f* of the cup-shaped member 24 is detachably attached by a connection method such as a screw connection as shown in FIG. 7, rather than the flange portion 24*f* being integrally provided with the cup-shaped member 24 as explained above.

Figure 8:
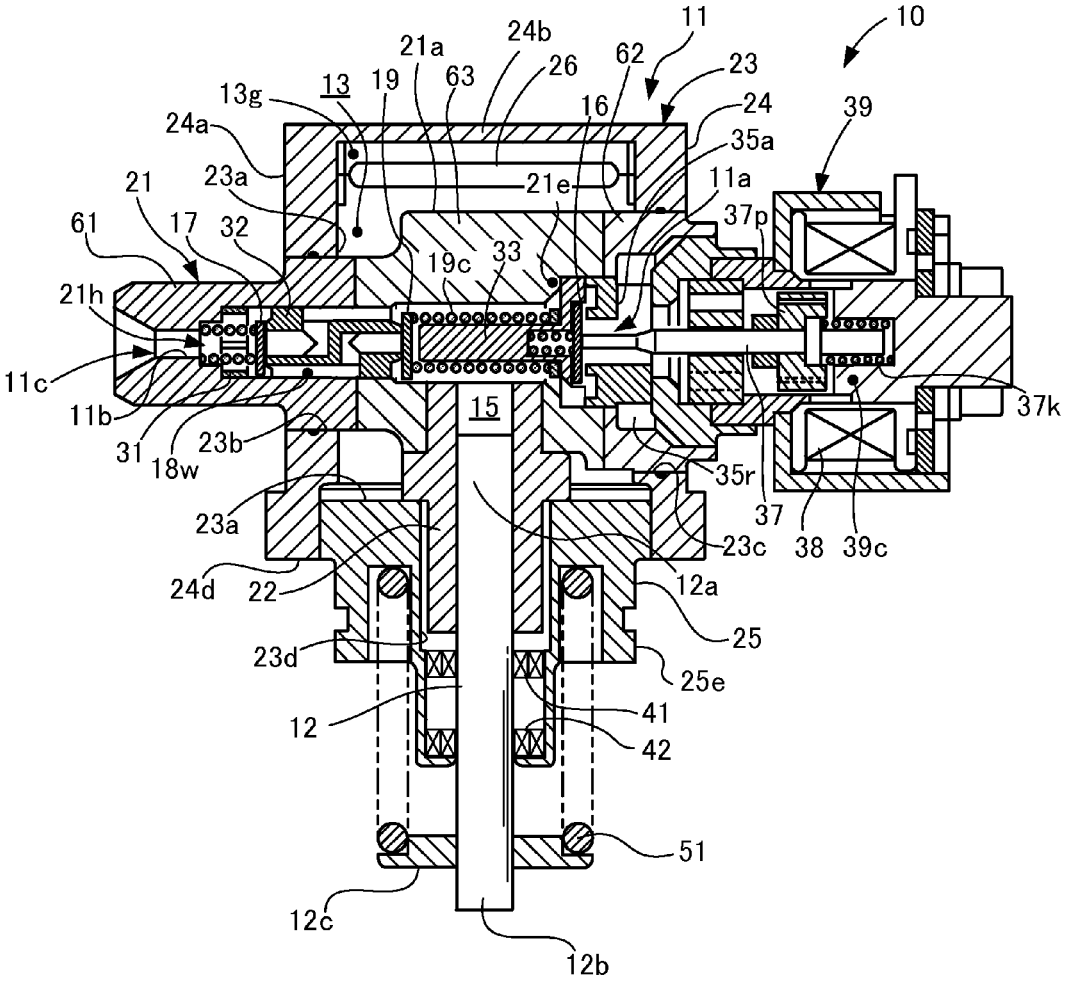
FIG. 8 is a front cross-sectional view showing another deformed state of the pump body of the fuel pump according to the embodiment of the present invention.

Alternatively, the outer shell member 23 may be so constructed to employ a bottomed cup-shaped member 24 having the lid portion 24*b* in one end side integrally provided therewith as shown in FIG. 8, rather than the cup-shaped member 24 having one end side of the tubular member 24*a* being closed by the lid portion 24*b* as explained above.

Further, as shown in FIG. 8, the valve retention member 21 has a pair of valve retention tubular portions 61, 62 and an intermediate tubular portion 63 formed therein, the pair of valve retention tubular portions 61, 62 respectively spacing apart from each other in the suction side and in the discharge side of the fuel pressurizing chamber 15 to be axially held in face-to-face relationship with each other, the intermediate tubular portion 63 being disposed between the valve retention tubular portions 61, 62 to be connected to the insertion portion 22*a* (insertion unit) of the cylinder member 22. Furthermore, the fuel pressurizing chamber 15 is formed among the intermediate tubular portion 63 of the valve retention member 21, the insertion portion 22*a* of the cylinder member 22 and the plunger 12. Consequently, the intermediate tubular portion 63 can be attached to the outer shell member 23 simultaneously with inserting the pair of valve retention tubular portions 61, 62, and the intermediate tubular portion 63 with the front end portion of the cylinder member 22 received therein can be attached in the outer shell member 23 simultaneously with inserting the cylinder member 22 in the cup-shaped member 24 of the outer shell member 23.

In this case, the intermediate tubular portion 63 may be integrally formed with the cylinder member 22 to have the fuel pressurizing chamber 15 formed in the intermediate tubular portion 63. This means that the fuel pressurizing chamber 15 may be formed by the insertion unit (a closing end portion equivalent to the integrated tubular intermediate portion 63) of the cylinder member 22 and the plunger 12, the insertion unit of the cylinder member 22 having a closing end portion in the suction gallery chamber 13. In other words, in this case, the insertion unit of the cylinder member 22 has the plunger 12 reciprocatably accommodated therein, while the insertion unit of the cylinder member 22 is constituted by a bottomed tubular body, closed by an internal end side thereof, positioned in the outer shell member 23. The insertion unit of the cylinder member 22, constituted by the bottomed tubular body, has a pair of communicating holes formed on the peripheral wall portion thereof, the pair of communicating holes (communicating holes arranged adjacent to the fuel pressurizing chamber 15 as a part of the suction passage 11*a* and the discharge passage 11*b*) being communicated with the suction passage 11*a* and the discharge passage 11*b* respectively in the pair of the valve retention tubular portions 61, 62. The intermediate tubular portion 63, which is integrated with the cylinder member 22, and the pair of valve retention tubular portions 61, 62, which are to be radially fitted in the outer shell member 23, may preferably have a fitting portion provided therein, the fitting portion being adapted to have the intermediate tubular portion 63 and the pair of valve retention tubular portions 61, 62 positioned in axial alignment with each other and fitted in each other.

Figure 9:
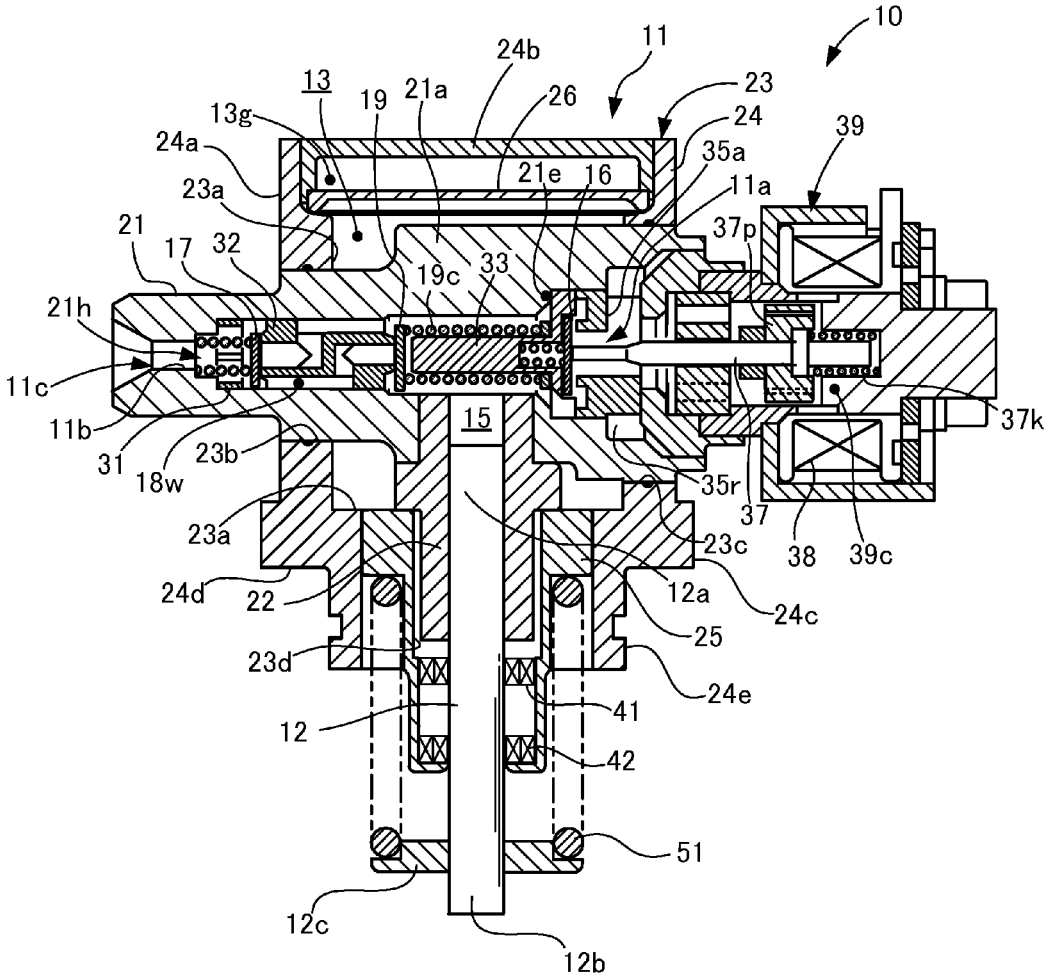
FIG. 9 is a front cross-sectional view showing still another deformed state of the pump body of the fuel pump according to the embodiment of the present invention.
Figure 10:
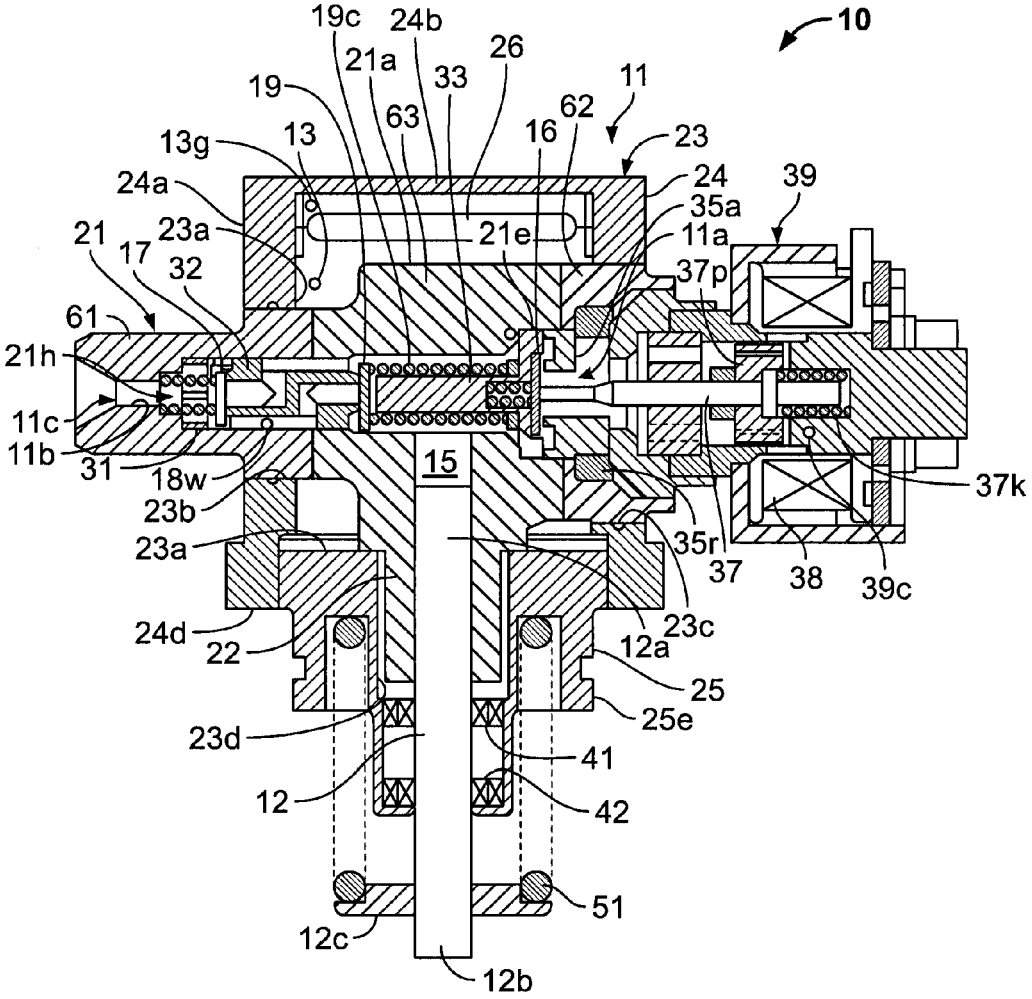
FIG. 10 is a front cross-sectional view showing another deformed state of the pump body of the fuel pump according to the embodiment of the present invention.

Further, as shown in FIG. 9, the fuel pump according to the present embodiment may be so constructed to have a diameter of the oil seal holder 25 suppressed to a level slightly larger than a diameter of the flange portion 22*b* of the cylinder member 22, the oil seal holder 25 being adapted to close the open end portion 24*c* of the cup-shaped member 24, while having a boss portion 24*e* arranged at the open end portion 24*c* of the cup-shaped member 24, the boss portion 24*e* coaxially extending from the attachment base surface 24*d* toward the plunger 12.

The foregoing embodiment of the fuel pump according to the present embodiment is directed to the case in which all of the first insertion holes 23*b*, 23*c* and the second insertion hole 23*d* are the holes penetrating through the peripheral wall portion or end wall portion of the outer shell member 23. However, the fuel pump according to the present embodiment may otherwise be so constructed that the first insertion holes 23*b*, 23*c* and the second insertion hole 23*d* are penetrating through the inner wall surface 23*a* only without penetrating the outer wall surface of the peripheral wall portion or end wall portion of the outer shell member 23, as long as the fuel pump is so constructed that the valve retention member 21 and the cylinder member 22 are being communicated with each other and are reliably supported at three points in the outer shell member 23. Further, the foregoing embodiment of the fuel pump according to the present invention is directed to the case in which each of axis lines of the first insertion holes 23*b*, 23*c* and an axis line of the second insertion hole 23*d* are orthogonally crossing with respect to each other. However, the fuel pump according to the present embodiment may otherwise be so constructed that each of axis lines of the first insertion holes 23*b*, 23*c* and an axis line of the second insertion hole 23*d* are crossing with respect to each other by an intersection angle not equal to 90 degrees. Furthermore, the foregoing embodiment of the fuel pump according to the present invention is directed to the case in which the valve bodies 16*a*, 17*a* and 19*a* respectively of the suction valve 16, the discharge valve 17 and the relief valve 19 are formed in a plate shape. However, it is needless to say that the fuel pump according to the present embodiment may otherwise be so constructed that the valve bodies 16*a*, 17*a* and 19*a* may be formed in a spherical valve shape or other known valve shapes.

The foregoing embodiment of the fuel pump according to the present invention is directed to the case in which the suction gallery chamber 13 is formed by the outer peripheral surfaces 21*f*, 22*f* respectively of the valve retention member 21 and the cylinder member 22 and the inner wall surface 23*a* of the outer shell member 23. However, the fuel pump according to the present invention may otherwise be so constructed that the cylinder member 22 is accommodated in the valve retention member 21 and the oil seal holder 25, so that the cylinder member 22 is not exposed in the suction gallery chamber 13, in the case that the oil seal holder 25, forming part of the outer shell member 23, is integrally formed with the cylinder member 22, so that the valve retention member 21 and the cylinder member 22 are connected with each other at the same time with one end of the cup-shaped member 24 being closed by the oil seal holder 25. Further, the valve retention member 21 is designed to form the suction gallery chamber 13 by an entire peripheral surface of the outer peripheral surface 21*f* of the insertion unit 21*a*. However, the fuel pump according to the present invention may otherwise be so constructed that the suction gallery chamber (fuel storage chamber) is formed by a peripheral part of the outer peripheral surface 21*f* of the valve retention member 21 and the inner wall surface of the outer shell member 23, which is held in face-to-face relationship with the outer peripheral surface 21*f*, so that the suction gallery chamber has a lateral cross-sectional view, for example, in a crescent shape. This means that the fuel pump according of the present invention does not necessarily require the valve retention member 21 to be received in by the outer shell member 23 for the suction gallery chamber to be formed.

Further, the foregoing embodiment of the fuel pump according to the present embodiment is directed to the case in which the valve retention member 21 is received in by the pair of first insertion holes 23*b*, 23*c* of the outer shell member 23 and the cylinder member 22 is received in by the second insertion hole 23*d* as well as is supported by the valve retention member 21. However, the fuel pump according to the present invention may otherwise be so constructed to have only one of the first insertion hole. This means that one end portion of the valve retention member 21 is penetrated through the inner wall surface 23*a* of the outer shell member 23, while the other end portion of the valve retention member 21 is not penetrated through the inner wall surface 23*a*, however is supported by the outer shell member 23. In this case, for example, the discharge side fuel passage connecting to outside is not formed in the valve retention member 21, however is formed in the side of the outer shell member 23 on an extension line of a central axis line of the valve retention member 21. Further, in the case that the valve retention member 21 is received in by the pair of the first insertion holes 23*b*, 23*c*, the peripheral surface 21*f* of the insertion unit 21*a* may be held in contact with the outer shell member 23 on a part of peripheral directions, so that the suction gallery chamber 13 is divided into a plurality of fuel storage chambers.

From the foregoing description, it will be appreciated that the fuel pump according to the present invention can reduce the weight of the pump body, while making it possible to drastically facilitate the machining of the fuel passage, the fuel pressurizing chamber and the like. Furthermore, the fuel pump according to the present invention can form the large volume fuel storage chamber capable of storing the fuel in the outer shell member in the upstream side of the suction valve. As a consequence, the fuel pump according to the present invention can suppress an excess thickness and an increase in size of the structure of the pump body, so that the fuel pump is miniaturized and light-weighted, thereby making it possible to improve the productivity and lower the cost. Therefore, the fuel pump according to the present invention is useful for all the types of fuel pump suitable to pressurize the fuel of the internal combustion engine to sufficiently high pressure for cylinder injection.

EXPLANATION OF REFERENCE NUMERALS

10: fuel pump (fuel pressurizing pump, high-pressure pump)
11: pump body (pump housing)
11*a*: suction passage (fuel passage in suction side)
11*b*: discharge passage (fuel passage in discharge side)
12: plunger
13: suction gallery chamber (fuel storage chamber)
15: fuel pressurizing chamber
16: suction valve (valve element)
16*a*, 17*a*, 19*a*: valve body
16*b*, 17*b*, 19*b*: valve seat
17: discharge valve (valve element)
18*w*: bypass passage
19: relief valve (valve element)
21: valve retention member (tubular body)
21*a*: insertion unit
21*c*: axial intermediate portion
21*f*, 22*f*: outer peripheral surface (outer surface)
21*h*: valve accommodation hole
22: cylinder member
22*a*: insertion portion (insertion unit)
22*b*: flange portion (insertion unit)
23: outer shell member
23*a*: inner wall surface
23*b*, 23*c*: first insertion hole
23*d*: second insertion hole
24: cup-shaped member
24*a*: tubular portion (peripheral wall portion)
24*b*: lid portion (first closing portion)

25: oil seal holder (second closing portion)
26: resilient film member (diaphragm)
35*pw*: communication passage
35*r*: annular communication passage unit
39: electromagnetic operation unit
61, 62: valve retention tubular portion
63: intermediate tubular portion
C1, C2: axis line

The invention claimed is:

1. A fuel pump comprising:

a pump body having formed in its inner portion with a fuel passage to allow a fuel to be introduced therethrough into the inner portion, a plunger provided in the pump body to partly form a fuel pressurizing chamber to allow the fuel to be introduced thereinto and discharged therefrom, the plunger being reciprocatably displaceable in an axial direction in which the fuel in the fuel pressurizing chamber is pressurized, and a plurality of valve elements inclusive of a suction valve to have the fuel to be sucked into the fuel pressurizing chamber and a discharge valve to have the fuel to be discharged from the fuel pressurizing chamber, the pump body including a valve retention member partly forming the fuel passage, the valve retention member being in a tubular shape to retain the valve elements therein, a cylinder member supported by the valve retention member and slidably retaining the plunger, and an outer shell member having an inner wall surface which the valve retention member penetrates through, the inner wall surface of the outer shell member and an entire outer surface of an insertion unit of the valve retention member collectively constituting a fuel storage chamber, in which the outer shell member including a pair of first insertion holes, the pair of first insertion holes penetrates through the inner wall surface at opposite ends of the outer shell member in a same axial direction, an inner diameter of the pair of first insertion holes differ from each other, the outer surface of the valve retention member has a stepped cylindrical shape, and a diameter of the valve retention member becomes larger from one end portion towards an other end portion in an axial direction of the valve retention member.

2. The fuel pump as set forth in claim 1, in which the outer shell member has the pair of first insertion holes and a second insertion hole formed therein, the first insertion holes having a center axis and penetrating through the inner wall surface in the same direction with each other, the second insertion hole having a center axis crossing with the center axes of the first insertion holes, either one of the first insertion holes and the second insertion hole having the valve retention member received therein and the other one of the first insertion holes and the second insertion hole having the cylinder member received therein.

3. The fuel pump as set forth in claim 2, in which the first insertion hole of the outer shell member has the valve retention member received therein and the second insertion hole of the outer shell member has the cylinder member received therein.

4. The fuel pump as set forth in claim 2, in which the outer shell member, the valve retention member and the cylinder member collectively constituting the fuel storage chamber to be surrounded by the inner wall surface of the outer shell member and the outer surface of a received portion formed by a part of each of the valve retention member and the cylinder member received in the first insertion hole and the second insertion hole of the outer shell member.

5. The fuel pump as set forth in claim 1, in which the valve retention member has a valve accommodation hole formed therein, the valve accommodation hole axially aligning and accommodating the plurality of the valve elements therein.

6. The fuel pump as set forth in claim 1, in which the outer shell member has a peripheral wall portion, a first closing portion, and a second closing portion, the peripheral wall portion having the first insertion holes formed therein, the first closing portion being arranged to close one end portion in an axial direction of the peripheral wall portion, the second closing portion being arranged to close the other end portion in the axial direction of the peripheral wall portion and having the second insertion hole formed therein.

7. The fuel pump as set forth in claim 6, in which the outer shell member has a resilient film member arranged therein, the resilient film member being arranged in the vicinity of the first closing portion and receives a pressure of the fuel stored in the fuel storage chamber.

8. The fuel pump as set forth in claim 1, in which the fuel pressurizing chamber is formed by the plunger and at least either one of the valve retention member and the cylinder member.

9. The fuel pump as set forth in claim 8, in which the valve retention member is formed by a tubular body penetrating through the outer shell, the cylinder member is connected with the valve retention member in the outer shell member, and the fuel pressurizing chamber is formed by the valve retention member, the cylinder member and the plunger.

10. The fuel pump as set forth in claim 9, in which the valve retention member has a pair of valve retention tubular portions and an intermediate tubular portion, the pair of valve retention tubular portions being spaced apart from each other in a suction side and a discharge side of the fuel pressurizing chamber and facing each other in an axial direction, the intermediate tubular portion being disposed between the pair of valve retention tabular portions and connected with the cylinder member, and the fuel pressurizing chamber is formed by the intermediate tubular portion of the valve retention member, the cylinder member and the plunger.

11. The fuel pump as set forth in claim 8, in which the valve retention member is constituted by a tubular body penetrating through the outer shell, the cylinder member is connected with the valve retention member in the outer shell member, and the fuel pressurizing chamber is formed by the cylinder member and the plunger.

12. The fuel pump as set forth in claim 1, in which the valve retention member penetrates through the inner wall surface of the outer shell member via the pair of first insertion holes and the fuel storage chamber extends from one of the pair of first insertion holes to the other of the pair of first insertion holes.

13. A fuel pump comprising:

a pump body having formed in its inner portion with a fuel passage to allow a fuel to be introduced therethrough into the inner portion, a plunger provided in the pump body to partly form a fuel pressurizing chamber to allow the fuel to be introduced thereinto and discharged therefrom, the plunger being reciprocatably displaceable in an axial direction in which the fuel in the fuel pressurizing chamber is pressurized, and a plurality of valve elements inclusive of a suction valve to have the fuel to be sucked into the fuel pressurizing chamber and a discharge valve to have the fuel to be discharged from the fuel pressurizing chamber, the pump body including a valve retention member partly forming the fuel passage, the valve retention member being in a tubular shape to retain the valve elements therein, a cylinder member supported by the valve retention member and slidably retaining the plunger, and an outer shell member having an inner wall surface which the valve retention member penetrates through, the inner wall surface of the outer shell member and an outer surface of the valve retention member collectively constituting a fuel storage chamber, wherein the fuel pressurizing chamber is formed by the plunger and at least either one of the valve retention member and the cylinder member, wherein the valve retention member is constituted by a tubular body penetrating through the outer shell, the cylinder member is connected with the valve retention member in the outer shell member, and the fuel pressurizing chamber is formed by the cylinder member and the plunger, wherein the valve retention member has a pair of valve retention tubular portions spaced apart from each other in a suction side and a discharge side of the fuel pressurizing chamber, facing each other in an axial direction, to retain the suction valve and the discharge valve, the cylinder member has a bottomed tubular body reciprocatably accommodating the plunger therein to be closed in an inner end side positioned inside of the outer shell member, the bottomed tubular body has a pair of communication holes formed in a peripheral wall portion thereof, the pair of communication holes respectively communicating with fuel passages of the pair of valve retention tubular portions.

14. A fuel pump comprising:

a pump body having formed in its inner portion with a fuel passage to allow a fuel to be introduced therethrough into the inner portion, a plunger provided in the pump body to partly form a fuel pressurizing chamber to allow the fuel to be introduced thereinto and discharged therefrom, the plunger being reciprocatably displaceable in an axial direction in which the fuel in the fuel pressurizing chamber is pressurized, and a plurality of valve elements inclusive of a suction valve to have the fuel to be sucked into the fuel pressurizing chamber and a discharge valve to have the fuel to be discharged from the fuel pressurizing chamber, the pump body including a valve retention member partly forming the fuel passage, the valve retention member being in a tubular shape to retain the valve elements therein, a cylinder member supported by the valve retention member and slidably retaining the plunger, and an outer shell member having an inner wall surface which the valve retention member penetrates through, the inner wall surface of the outer shell member and an outer surface of the valve retention member collectively constituting a fuel storage chamber, wherein the valve retention member has a bypass passage and a relief valve formed therein, the bypass passage bypassing the discharge valve, the relief valve opening and closing the bypass passage, the relief valve being opened on the condition that a fuel pressure at a fuel discharge passage in a downstream side of the discharge valve in the fuel passage is higher than a fuel pressure at the fuel pressuring chamber by a predetermined value.

15. The fuel pump as set forth in claim 14, each of the suction valve and the relief valve has valve seat and a valve body, the valve seat of the suction valve and the valve seat of the relief valve being supported by the valve retention member to be spaced apart from each other in an axial direction of the valve retention member, the valve body of the suction valve and the valve body of the relief valve being displaced in the axial direction of the valve retention member, the fuel pressurizing chamber has a plurality of resilient members arranged therein, the plurality of resilient members urging the valve body of the suction valve and the valve body of the relief valve in the axial direction of the valve.

* * * * *